US007251940B2

(12) United States Patent
Graves et al.

(10) Patent No.: US 7,251,940 B2
(45) Date of Patent: Aug. 7, 2007

(54) AIR ASSIST FUEL INJECTOR FOR A COMBUSTOR

(75) Inventors: Charles B. Graves, South Windsor, CT (US); Stephanie DeSalle, Colchester, CT (US)

(73) Assignee: United Technologies Corporation, Hartford, CT (US)

( * ) Notice: Subject to any disclaimer, the term of this patent is extended or adjusted under 35 U.S.C. 154(b) by 416 days.

(21) Appl. No.: 10/837,305

(22) Filed: Apr. 30, 2004

(65) Prior Publication Data

US 2005/0241319 A1 Nov. 3, 2005

(51) Int. Cl.
*F23R 3/12* (2006.01)
*F23R 3/28* (2006.01)

(52) U.S. Cl. ..... 60/742; 60/748

(58) Field of Classification Search ..... 60/740, 60/742, 743, 746, 748
See application file for complete search history.

(56) References Cited

U.S. PATENT DOCUMENTS 4,198,815 A * 4/1980 Bobo et al. ..... 60/748
5,603,211 A 2/1997 Graves
5,782,626 A 7/1998 Joos et al.
5,966,937 A 10/1999 Graves
5,987,889 A 11/1999 Graves et al.
6,543,235 B1 4/2003 Crocker et al.
6,625,971 B2 9/2003 Graves
6,871,488 B2 * 3/2005 Oskooei et al. ..... 60/740

FOREIGN PATENT DOCUMENTS

EP 0 646 706 4/1995
EP 1 391 657 2/2004

OTHER PUBLICATIONS

European Search Report, Jul. 29, 2005.

* cited by examiner

*Primary Examiner*—L. J. Casaregola
(74) *Attorney, Agent, or Firm*—Carlson, Gaskey & Olds

(57) ABSTRACT

A fuel injector system provides an air assist fuel nozzle which includes a fuel shroud and an air portion. Air passes around the fuel shroud to air jets in the air portion to provide a focused application of air directly onto a fuel spray from each of a multiple of main fuel jets to impart additional velocity to the fuel as it is flowing out of the fuel nozzle. The air jets increase the resulting fuel spray velocity to a level high enough to reach a prefilmer wall of a swirler even during snap deceleration conditions.

16 Claims, 7 Drawing Sheets

AIR ASSIST FUEL INJECTOR FOR A COMBUSTOR

This invention was made with government support under Contract No.: N0019-02-C-3003. The government therefore has certain rights in this invention.

BACKGROUND OF THE INVENTION

The present invention relates to a fuel/air mixer for a combustor and more particularly to a focused application of air directly on the fuel spray as it is flowing out of a fuel injector to increase the transport of fuel spray during engine snap deceleration conditions.

One goal in the design of combustors, such as those used in gas turbine engines of high performance aircraft, is to minimize the amount of smoke produced by the combustion process in the gas turbine engine. For military aircraft in particular, smoke production creates a "signature" which may increase aircraft visibility.

Another objective in the design of combustors for high performance aircraft is to maximize the "static stability" of a combustor. The term "static stability" refers to the ability to initiate the combustion process at high airflows and low fuel flow during a rapid deceleration of the engine.

Leaning out the fuel/air mixture in the combustor minimizes smoke production, while static stability is increased by enriching the fuel/air mixture. Applicant has addressed the competing goals with a fuel injector design with an outer recirculation zone flame stabilization arrangement. Although effective, flame stability in such a fuel injector may still be relatively sensitive during snap deceleration conditions. Snap deceleration is of particular interest to the performance of military aircraft.

Spray transport is important to the operation of a fuel injector design intended for outer recirculation zone flame stabilization. Fuel is injected from a pressure atomizing fuel nozzle and reaches a prefilmer wall by one of two mechanisms. The first is a centrifuge mechanism. Large drops in a rotating environment are slung outboard to the prefilmer wall. A second mechanism is from velocity of the fuel itself. This fuel velocity typically results from the pressure available in the fuel system.

Conventional fuel injector systems may not provide sufficient spray transport across an inner passage airflow to reach the prefilmer wall under snap deceleration conditions as droplet sizes may be too small for effective centrifuge action to take place in the space available. Furthermore, there may be insufficient pressure drop across the fuel injector tip to provide sufficient velocity to traverse the inner passage at the fuel flow common to snap deceleration conditions. Such conventional fuel nozzle systems may thus suffer a loss in flame stability during snap deceleration conditions.

Accordingly, it is desirable to provide a fuel injector system that minimizes the amount of smoke production while maximizing stability even under snap deceleration conditions.

SUMMARY OF THE INVENTION

The fuel injector system according to the present invention provides an air assist fuel nozzle which includes a fuel shroud and an air portion. The fuel shroud defines a multiple of main fuel jets disposed off of a central axis. An air jet is located adjacent each of the main fuel jets.

Air passes around the fuel shroud to the air jets to provide a focused application of air directly onto the fuel spray from each of the main fuel jets to impart additional velocity to the fuel as it is flowing out of the fuel nozzle. The air jets provide an increased pressure drop across a swirler to mix with the fuel from the main fuel jets and increase the resulting fuel spray velocity to a level high enough to reach a prefilmer wall of the swirler even during snap deceleration.

Generally, the fuel jets and the air jets are arranged to: focus each air jet on a respective fuel jet; complement the air swirl of the swirler; provide initial interaction between air and fuel within a sheltered region to ensure effective momentum exchange; provide a sufficiently high momentum air jet to impart enough momentum to the fuel from the fuel jet to increase the fuel velocity and traverse the swirler inner passage; provide the air jet wide enough to overlap the fuel jet; and provide fuel nozzle external contours which are cleared away so that fuel does not attach to fuel nozzle surfaces and lose the momentum imparted by the air.

When the air assist fuel nozzle is combined with an outer recirculation zone stabilized swirler substantially lower fuel flow is required prior to the potential for a lean blowout condition in comparison to a conventional pressure atomizing nozzle and swirler combination.

The present invention therefore provides a fuel injector system which minimizes the amount of smoke production while maximizing stability even under snap deceleration conditions.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
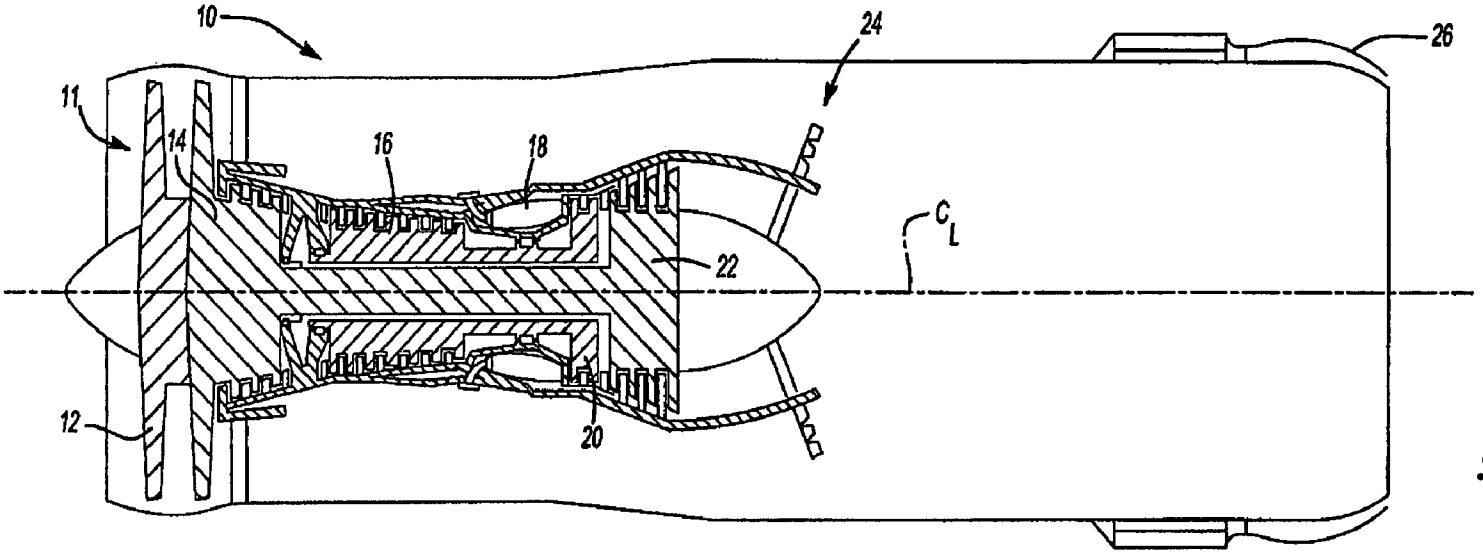
FIG. 1 is a general schematic cross-sectional view of a gas turbine engine for use with the present invention.

FIG. 1 illustrates a general cross-sectional view of a gas turbine engine 10. From an inlet 11, the major components of the engine 10 include a fan section 12, a low pressure axial compressor 14, a high pressure axial compressor 16, a burner section 18, a high pressure turbine 20, a low pressure turbine 22, an afterburner 24, and a nozzle 26.

Figure 2:
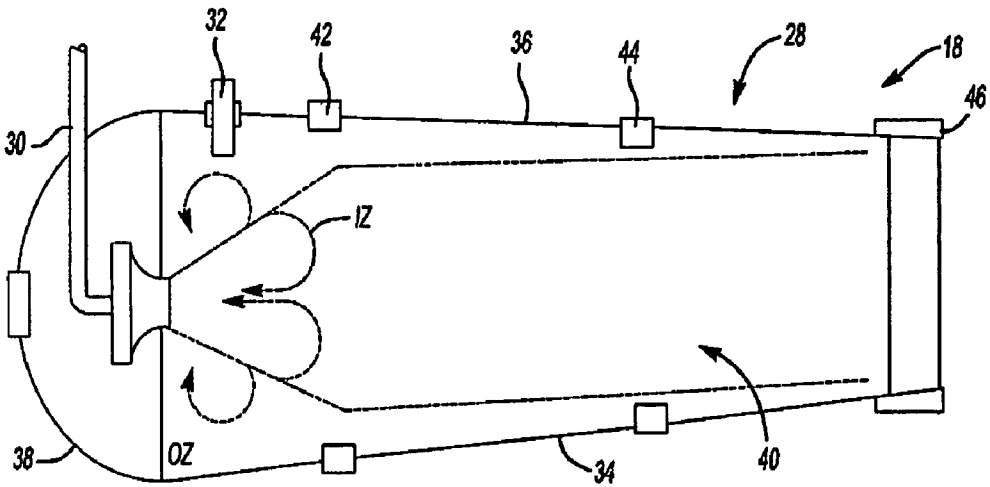
FIG. 2 is a general schematic block diagram of a combustor of a gas turbine engine.

Referring to FIG. 2, a cross-sectional view of a portion of the burner section 18 includes an annular combustor 28, fuel injectors 30, and spark igniters 32. The igniters 32 light the fuel/air mixture provided to the combustor 28 from the fuel injectors 30 during engine start.

The annular combustor 28 includes an inner liner 34, an outer liner 36, and a dome 38 joining the inner liner 34 and the outer liner 36 at an upstream end. A cavity 40 formed between the inner liner 34 and the outer liner 36 defines a combustion chamber.

The fuel injectors 30 are preferably mounted to the dome 38. The fuel injectors 30 provide fuel and air to the cavity 40 for combustion therein. The inner liner 34 and the outer liner 36 typically provide combustion holes 42 and dilution holes 44 which introduce secondary air into the cavity 40. Guide vanes 46 at the downstream end of the combustion chamber define the entrance to the high pressure turbine 20 (FIG. 1).

The expansion of the flow past the dome 38 and into the combustion chamber, along with the swirl created by the fuel injector 30, creates toroidal recirculation zones. Preferably, an outer recirculation zone OZ and an inner recirculation zone IZ provide hot combustion products upstream to mix with the uncombusted flow entering the combustion chamber. The hot combustion products provide a continuous ignition source for the fuel spray exiting the fuel injectors 30.

The engine 10 operates at a wide variety of power levels and the fuel injectors 30 control fuel flow to meet these varied fuel demands. At high power levels, which create the greatest demand for fuel, the fuel injectors 30 will supply the most amount of fuel to the engine 10. Conversely, the fuel injectors 30 supply the least amount of fuel to the engine 10 at low power levels, such as at engine start, idle and snap deceleration.

Figure 3A:
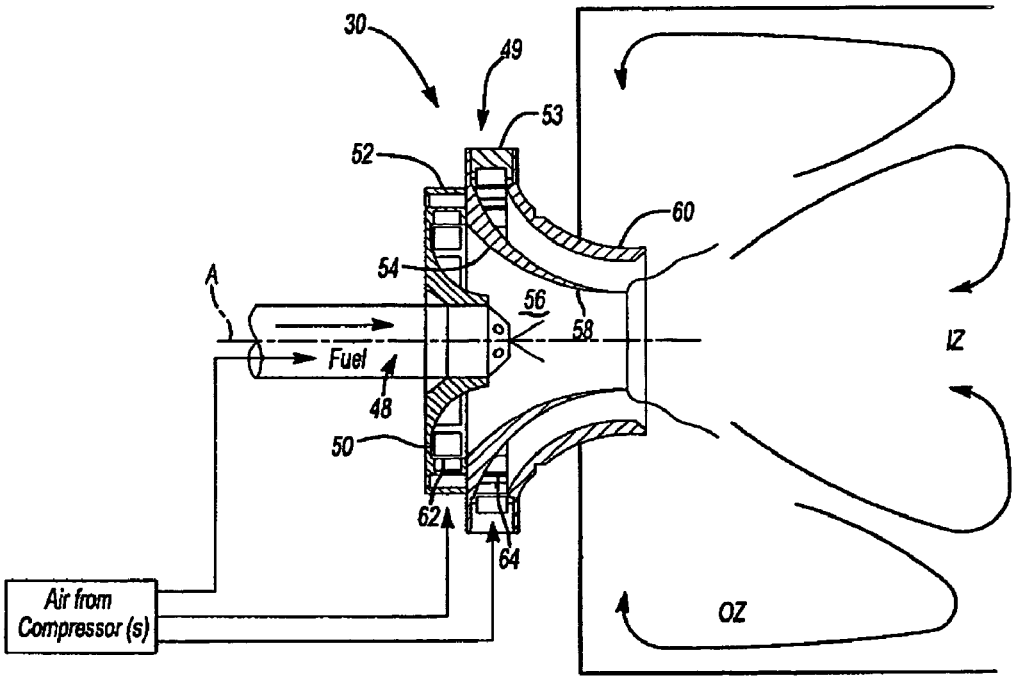
FIG. 3A is an expanded sectional view of a fuel injector and swirler system of the present invention.

Referring to FIG. 3A, each fuel injector 30 includes a fuel nozzle 48 along a fuel nozzle center line A to inject fuel F into the combustor 28 (FIG. 2). The fuel injector 30 includes the fuel nozzle 48 and a swirler 49 which surrounds the fuel nozzle 48. The swirler 49 concentrically surrounds the nozzle 48. The swirler 49 imparts a rotation to the air which is supplied by the compressors 14, 16. The rotating air impinges the fuel spray and imparts a rotation to the fuel F such that a vortex created by the swirler 49 provides additional control to the flame in the combustion chamber.

The fuel nozzle 48 further includes an air assist which imparts additional velocity to the fuel F as will be further described below. Such additional velocity is particular important during snap deceleration conditions.

The fuel nozzle 48 is located within a bearing plate 50 which is typically attached adjacent the dome 38 of the combustor 28 (FIG. 2). An inner radial swirler 52 includes a generally conical wall 54 which defines an inner passage 56 which surrounds the fuel nozzle 48 and is disposed in co-axial arrangement therewith.

A prefilmer wall 58 of the generally conical wall 54 operates as a prefilmer which, due to the swirling effect in the inner passage 56, causes the fuel spray to be centrifuged to the prefilmer wall 58 where it forms into a film that is moved axially toward the discharge end and into the combustor. The outer radial swirler 53 is concentrically disposed relative to the inner radial swirler 52 and defines the outer passage 60. Each of the radial swirlers 52, 53 include circumferentially spaced vanes 62, 64, respectively, which form vane passages. It should be understood that although a particular fuel injector arrangement is disclosed in the illustrated embodiment, other arrangements will benefit from the instant invention.

Figure 3B:
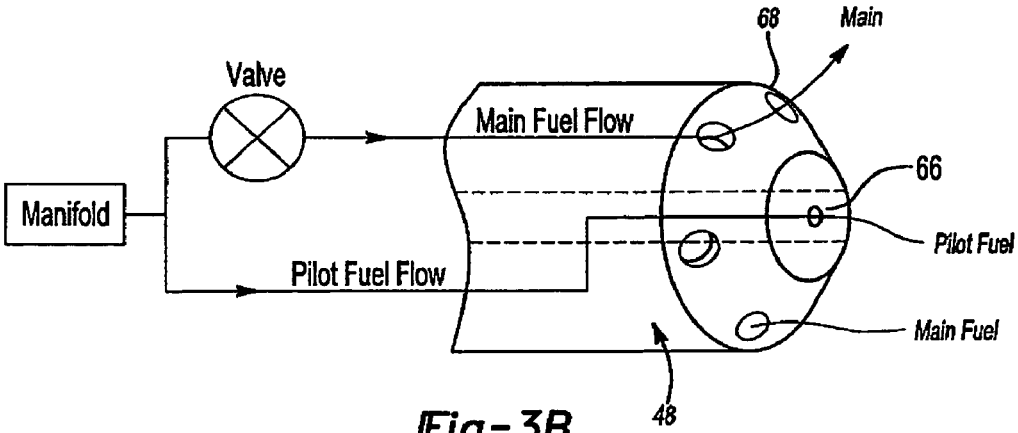
FIG. 3B is an expanded schematic view of a fuel nozzle.

Referring to FIG. 3B, the fuel nozzle 48 is a dual circuit pressure atomizing fuel nozzle (FIG. 3A). It consists of a "pilot" circuit, which has a small flow area, and a "main" circuit, which has a much larger flow area. The pilot circuit is typically directly fed from manifold pressure and consequently has a high velocity. The main flow circuit must be sized large enough to handle the fuel flow requirements of high pressure full power operation. Consequently, lower flows are achieved in the main circuit by use of a control valve. At low flows, the manifold pressure is substantially lost across the valve. A combustor 28 (FIG. 2) employs dual fuel nozzles which have both a "pilot" and "main" circuits or a single "main" circuit. In either application, the "main" circuit lacks the fuel velocity to be effective at snap deceleration conditions. In general, other considerations such as fuel nozzle coking mitigation drive the flow in the main circuit to a level high enough that it must be eased effectively during snap deceleration conditions. As such, all descriptions of air interaction with fuel involve air imparting momentum to the main circuit. It should be understood that it may not always be necessary to utilize a pilot circuit in fuel system architecture. Some nozzles may utilize only a main circuit, but in high pressure ratio engines 20:1 and greater the main flow is typically regulated by a valve (FIG. 3B). There may or may not be a pilot circuit. The pilot circuit does provide some secondary effect on the air assist operation, because the flow to the pilot circuit reduces the amount of fuel that needs to be accelerated by the momentum exchange with air. Since the fuel in the main circuit essentially has zero momentum of it's own, reducing that flow permits the remaining flow to achieve a higher velocity—provided the mass flow rate of the air is fixed.

Figure 4A:
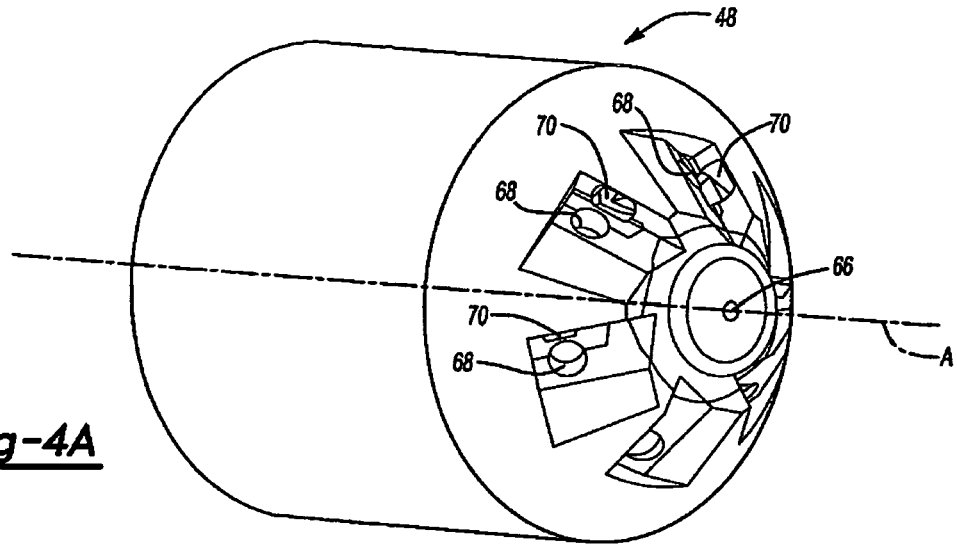
FIG. 4A is an expanded perspective view of one embodiment of a fuel nozzle of the present invention.
Figure 4B:
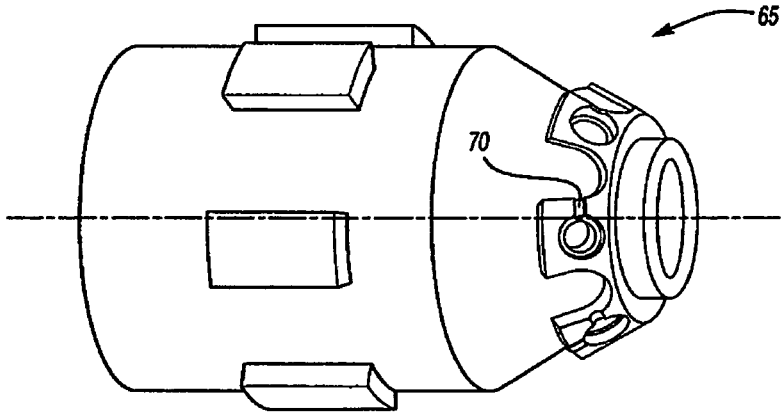
FIG. 4B is an expanded perspective view of a fuel shroud of the fuel nozzle of FIG. 4A.
Figure 4C:
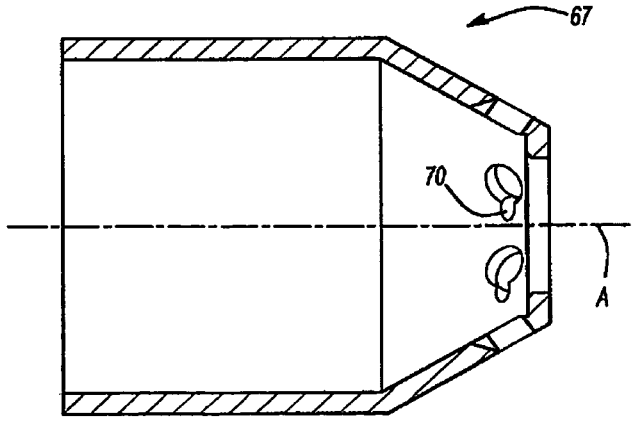
FIG. 4C is an expanded sectional view of an air portion of the fuel nozzle of FIG. 4A.

Referring to FIG. 4A, the fuel nozzle 48 is separately illustrated without the swirler 49. The fuel nozzle 48 includes a fuel shroud 65 (FIG. 4B) and an air shroud 67 (FIG. 4C) which fits over the fuel shroud 65. That is, fuel passes within the fuel shroud 65 through the main fuel circuit in the space subtended by the fuel shroud 65 and a pilot shroud 69 (FIG. 4D) while air passes through the annular space subtended by the fuel shroud 65 and the air shroud 67. The fuel and air portion remain separate until mixed at their exits (FIG. 4F).

Figure 4D:
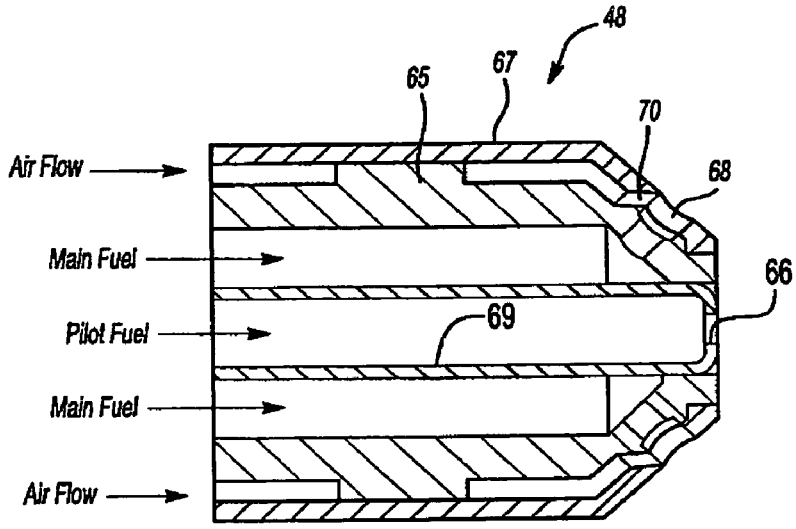
FIG. 4D is an expanded sectional view of the fuel nozzle of FIG. 4A in an assembled condition.

The fuel shroud 65 defines a pilot fuel jet 66 along the axis A and a multiple of main fuel jets 68 disposed off of the axis A and in a radial arrangement about the pilot fuel jet 66. The pilot fuel jet 66 receives fuel from a pilot fuel circuit while the multiple of main fuel jets 68 receive fuel from the main-fuel circuit (FIG. 4D). The pilot fuel circuit preferably communicates directly with a fuel manifold while the main fuel circuit is a moderated fuel circuit which may be selectively tailored (FIG. 3B). Typically during engine start, only the pilot fuel circuit is operational while during typical operation the majority of fuel flow is through the secondary fuel circuit. The main circuit flow becomes the majority flow above ground idle.

Figure 4E:
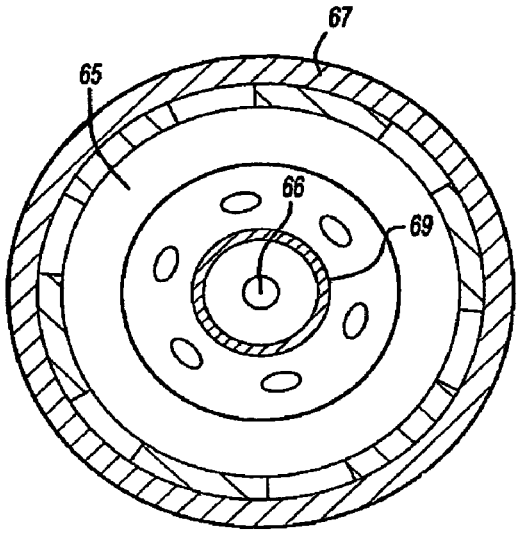
FIG. 4E is an expanded end view of the fuel nozzle of FIG. 4A.

An air jet 70 is located adjacent each of the main fuel jets 68 (FIG. 4A). It should be understood that although a single air jet is associated with a single fuel jet in the illustrated embodiment, any number and combination of fuel and/or air jets will also benefit from the present invention. The air jets 70 preferably receive air flow from the engine compressor as does the swirler 49. Air passes around the fuel shroud 65 to the air jets 70 (FIGS. 4D and 4E). The air jets 70 provide a focused application of air directly onto the fuel spray from each of the main fuel jets 68 to impart additional velocity to the fuel as it is flowing out of the fuel nozzle (also illustrated in FIG. 5). The air provides a sufficient pressure drop across the swirler 49 (FIG. 3A) to mix with the small amount of fuel from the main fuel jets 68 that exist at a snap deceleration condition and increase the resulting fuel spray velocity to a level high enough to reach the prefilmer wall 58 (FIG. 3A) during snap deceleration.

Figure 4F:
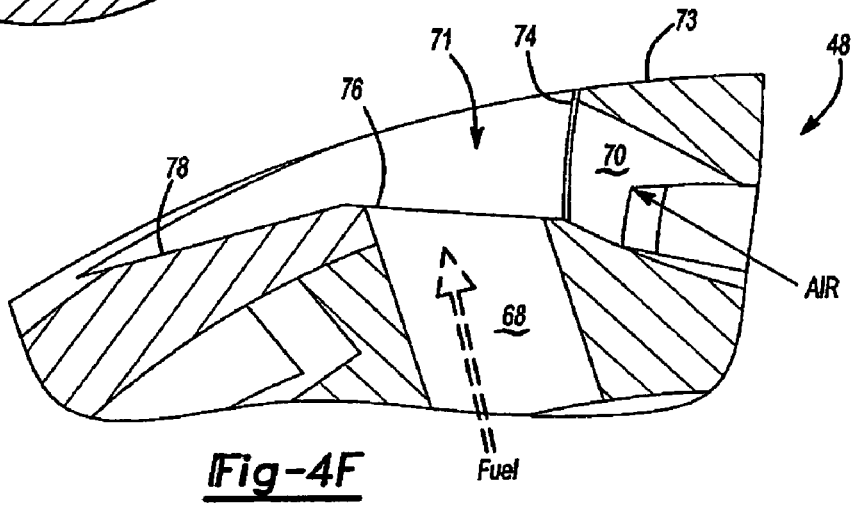
FIG. 4F is an expanded sectional view of an air jet and fuel jet interface of the fuel nozzle of FIG. 4A.

Referring to FIG. 4F, each set of main fuel jets 68 and associated air jets 70 are located within a recess 71 in an outer surface 73 of the fuel nozzle 48. Preferably, the recess 71 includes a first wall 74 which includes the air jet 70, and a second wall 76 which includes the radial fuel jet 68 generally perpendicular to the first wall 74. A third wall 78 preferably forms an obtuse angle with the second wall 76 to provide a clear path for the interaction of the fuel spray and air jet to reduce the momentum loss from the interaction thereof.

Generally, the fuel jets 68 and the air jets 70 are arranged to: focus each air jet on a respective fuel jet; complement the air swirl of the swirler 49; provide initial interaction between air and fuel within a sheltered region to ensure effective momentum exchange; provide a sufficiently large air jet to impart enough momentum to the fuel from the fuel jet 68 to increase the fuel velocity and traverse the swirler inner passage 56 (FIG. 3); provide the air jet wide enough to overlap the fuel jet; and provide fuel nozzle external contours which are cleared away so that fuel does not attach to fuel jet surfaces and lose the momentum imparted by the air. Applicant has also determined that the incidence angle of the air jet is relatively unimportant. Incidence angles between 45 and 75 degrees have proven effective.

Figure 5:
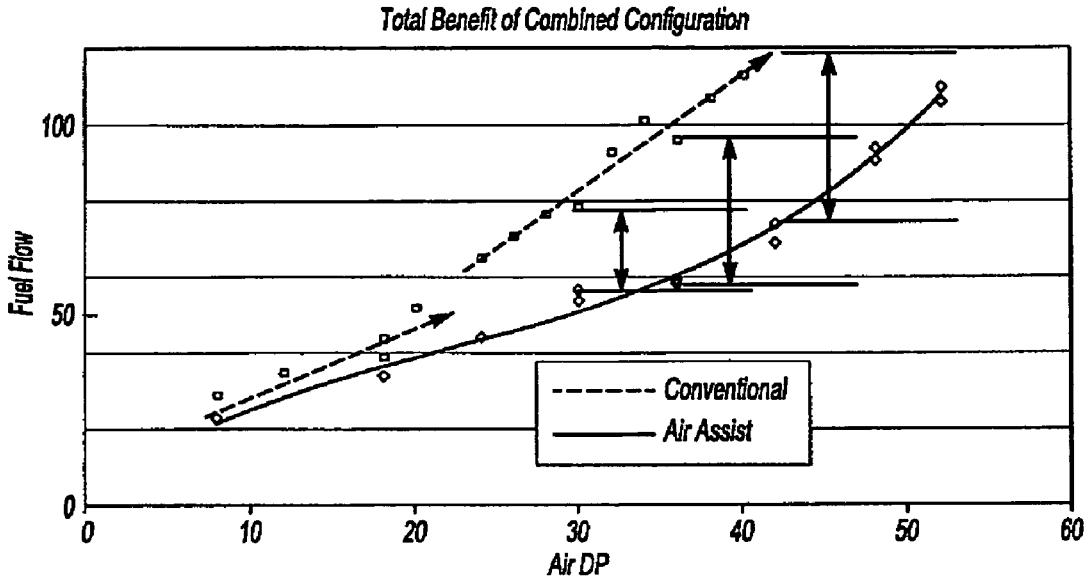
FIG. 5 is a graphical representation of an air assist fuel nozzle according to the present invention as compared to a conventional fuel nozzle.

Referring to FIG. 5, when the air assist fuel nozzle 48 is combined with the outer recirculation zone stabilized swirler 49, the air assist fuel nozzle 48 will achieve a substantially lower fuel flow at lean blowout conditions in comparison to a conventional pressure atomizing nozzle and swirler combination. The air assist fuel nozzle 48 provides particular benefit during snap deceleration. That is, at higher-pressure drop levels, when the fuel droplet sizes are small, the centrifuge process from the swirler may be of minimal effectiveness and fuel velocity is increased by the air assist fuel nozzle.

Figure 6A:
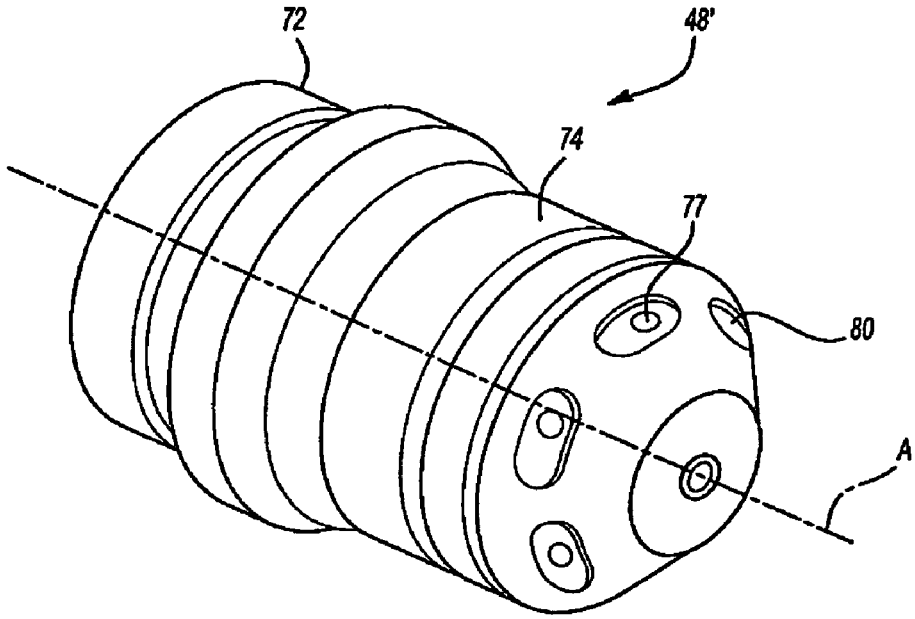
FIG. 6A is an expanded perspective view of another embodiment of a fuel nozzle of the present invention.
Figure 6B:
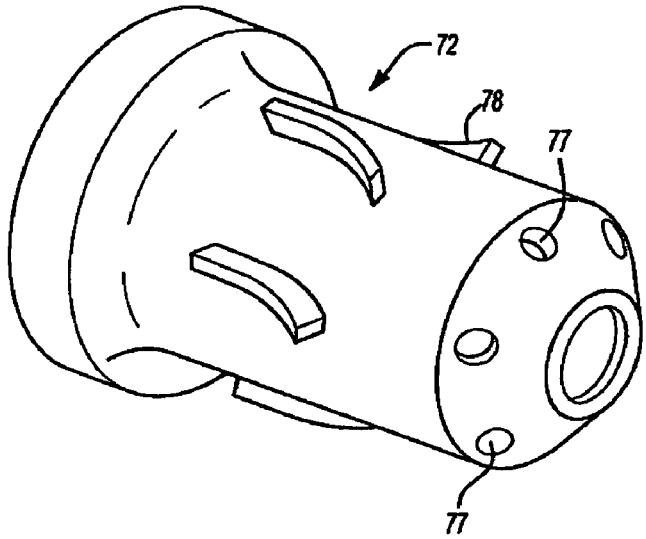
FIG. 6B is an expanded perspective view of a fuel shroud of the fuel nozzle of FIG. 6A.
Figure 6C:
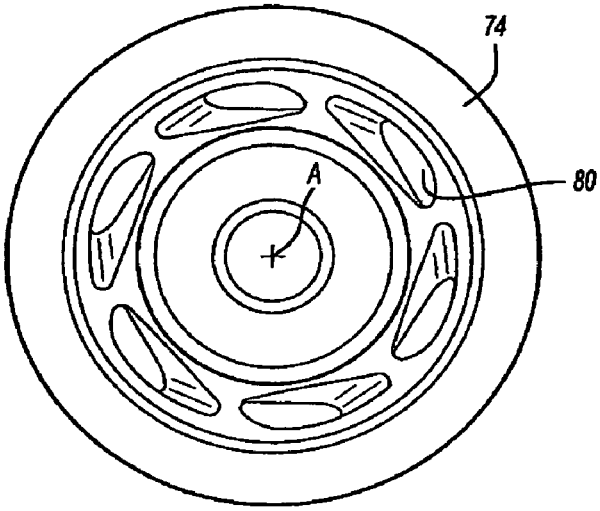
FIG. 6C is an expanded sectional view of an air portion of the fuel nozzle of FIG. 6A.
Figure 6D:
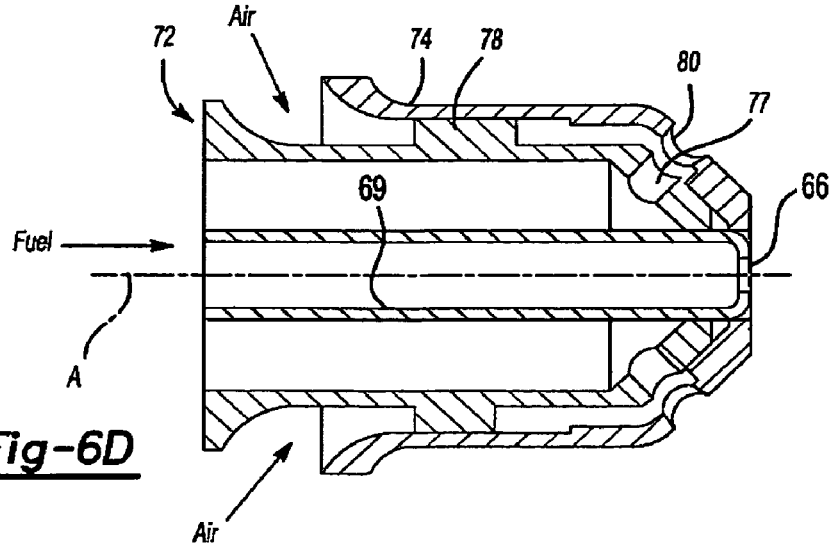
FIG. 6D is an expanded sectional view of the fuel nozzle of FIG. 6A in an assembled condition.
Figure 6E:
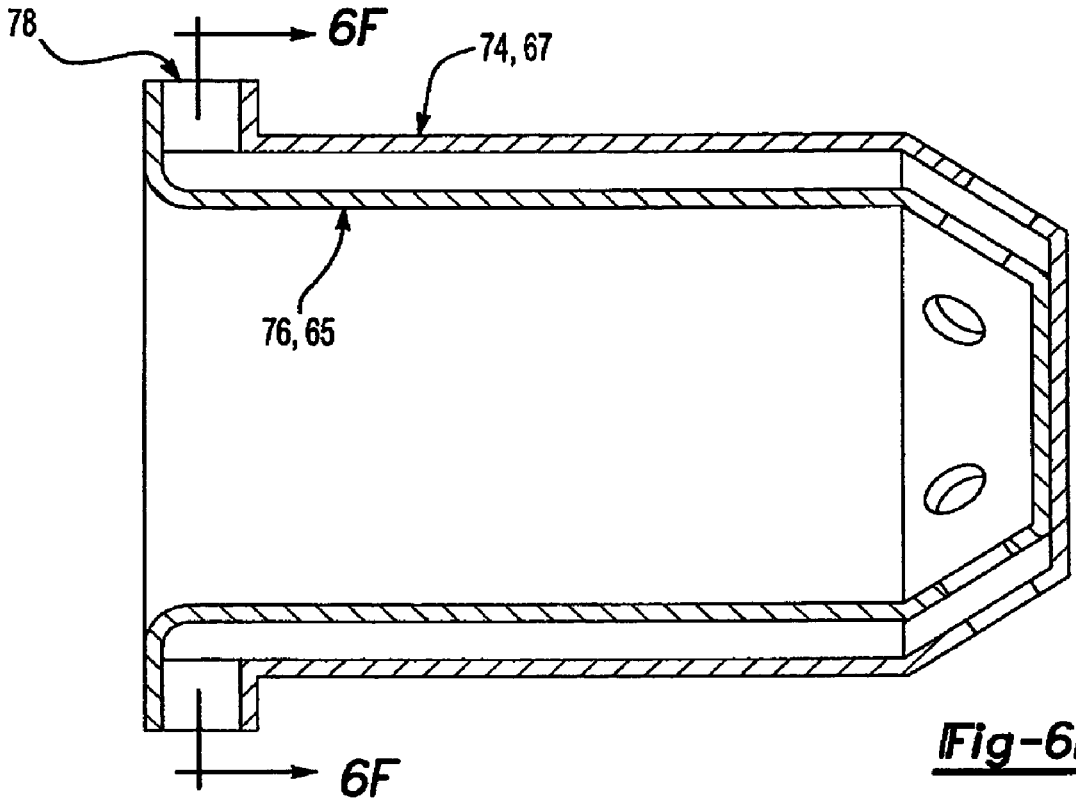
FIG. 6E is an expanded sectional view of an air jet and fuel jet interface of the fuel nozzle of FIG. 6A.
Figure 6F:
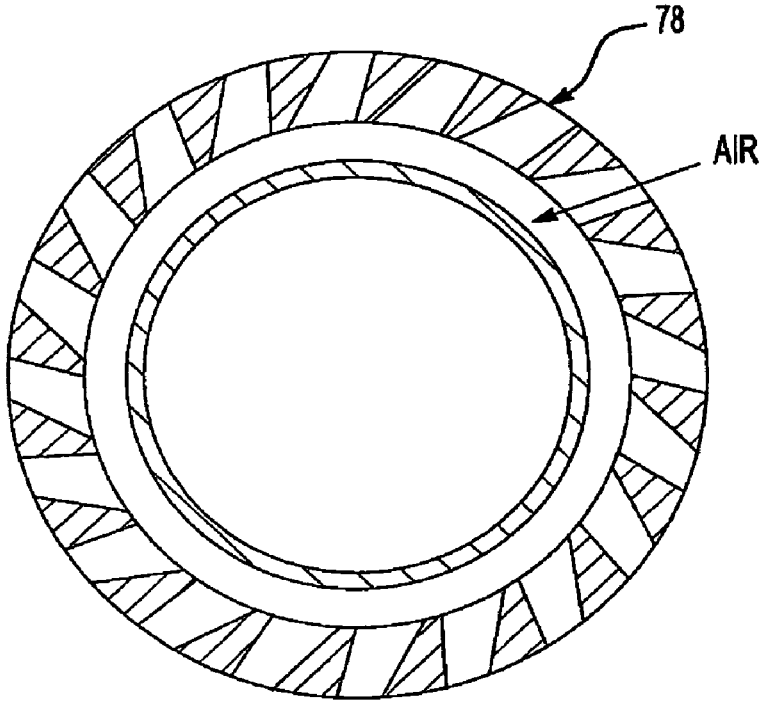
FIG. 6F is a sectional view of along line 6F-6F in FIG. 6E.

Referring to FIG. 6A, another fuel nozzle 48' is illustrated. The fuel nozzle 48' includes a fuel shroud 72 (FIG. 6B) and an air portion 74 (FIG. 6C) which fits over the fuel shroud 65. The fuel shroud 72 defines a multiple of main fuel jets 77 disposed off of a central axis A. A multiple of axial vanes 78 are disposed on the outer surface of the fuel shroud 72. The radial vanes 78 support the air portion 74 and impart rotation to airflow between the inner fuel shroud 72 and the outer air portion 74 (FIG. 6D). It should be understood that other vane configurations, such as the radial vanes 78 of FIGS. 6E and 6F could alternatively and or additionally be utilized.

Preferably, the air portion 74 includes a multiple of elongated apertures 80 which provide sufficient clearance for the combined fuel-air spray to pass. The elongated apertures 80 permit fuel spray from each of the main fuel jets 77 to minimize contact with the air portion 74 such that the resulting fuel spray reaches the prefilmer wall 58 (FIG. 3A) even during snap deceleration.

Referring to FIG. 6D, each of the main fuel jets 77 is sheltered from airflow through the engine by the elongated apertures 80. That is, the elongated apertures 80 shelter the main fuel jet 77 from airflow through the burner section 18 (FIG. 3A—and toward the viewer in FIG. 6F) not due to rotational airflow from the radial vanes 78. The radial vanes 78 provide a direction to the airflow within the fuel nozzle 48' such that the airflow passes out of the elongated apertures 80 with a rotational direction. It is preferred that each main fuel jet 77 is located toward the windward side of the elongated apertures 80 and the number of radial vanes 78 are equivalent to the number of main fuel jet 77.

The foregoing description is exemplary rather than defined by the limitations within. Many modifications and variations of the present invention are possible in light of the above teachings. The preferred embodiments of this invention have been disclosed, however, one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A fuel injector comprising:

a fuel nozzle which comprises a multiple of fuel jets and multiple of air jets, each of said air jets at least partially focused toward one of said fuel jets to direct an airflow from said fuel nozzle in a rotational direction, said fuel nozzle having a fuel shroud and an air shroud, said air shroud at least partially surrounds said fuel shroud.

2. The fuel injector as recited in claim 1, wherein said fuel nozzle defines a central axis, said fuel jet comprises a multiple of main fuel jets disposed off said axis.

3. The fuel injector as recited in claim 2, wherein said fuel nozzle defines a central axis, said fuel jet comprises a primary fuel jet disposed upon said central axis.

4. The fuel injector as recited in claim 1, further comprising an axial vane located about an outer surface of said fuel shroud.

5. The fuel injector as recited in claim 4, wherein said axial vane spaces said air shroud from said fuel shroud.

6. The fuel injector as recited in claim 1, wherein said air jet and said fuel jet are located within a recessed space within said fuel nozzle.

7. The fuel injector as recited in claim 1, further comprising a swirler defined about said fuel nozzle, said swirler operable to impart a rotation to an airflow adjacent said fuel nozzle in a first rotational direction.

8. A burner section of a gas turbine engine, comprising:

a combustion chamber;

a swirler located within said combustion chamber along an axis, said swirler imparts a rotation to an airflow adjacent a fuel nozzle in a first rotational direction; and a fuel injector mounted within said swirler along the axis, said fuel injector operable to supply fuel to said combustion chamber, said fuel injector comprising said fuel nozzle with a fuel jet and an air jet, said air jet at least partially focused toward said fuel jet to direct an airflow from said fuel nozzle in said first rotational direction.

9. The burner section as recited in claim 8, wherein said swirler defines an inner recirculation zone and an outer recirculation zone within said combustion chamber.

10. The burner section as recited in claim 8, wherein said swirler comprises a prefilmer wall, said air jet operable to direct an airflow from said fuel nozzle sufficient to impart momentum to the fuel from said air jet.

11. A fuel nozzle, comprising:

a pilot fuel jet disposed on a longitudinal central axis;

a multiple of main fuel jets disposed off said central axis for dispensing fuel; and a multiple of air jets, disposed off said central axis, each of said air jets adjacent one of said multiple of said fuel jets for dispensing in a rotational direction about said central axis, wherein said air impinges upon said fuel to increase a velocity of said fuel.

12. A fuel injector comprising:

a fuel nozzle including a fuel shroud and an air shroud, said air shroud at least partially surrounding said fuel shroud, said fuel shroud having a fuel jet and said air shroud having an air jet, said air jet at least partially focused towards said fuel jet, said air jet forming multiple elongated apertures through said air shroud.

13. A fuel injector comprising:

a fuel nozzle having a fuel jet and an air jet, said air jet at least partially focused toward said fuel jet; and a swirler defined about said fuel nozzle, said swirler operable to impart a rotation to an airflow adjacent said fuel nozzle and a first rotational direction wherein said air jet directs an airflow from said fuel nozzle in said first rotational direction.

14. The fuel injector as recited in claim 1, wherein said multiple of fuel jets and said multiple of air jets are arranged in a one to one correspondents.

15. The fuel injector as recited in claim 1, wherein said multiple of fuel jets are main fuel jets disposed off a central axis.

16. The fuel injector as recited in claim 15, further comprising a pilot fuel jet disposed on said longitudinal central axis.

* * * * *

UNITED STATES PATENT AND TRADEMARK OFFICE

CERTIFICATE OF CORRECTION

PATENT NO. : 7,251,940 B2
APPLICATION NO. : 10/837305
DATED : August 7, 2007
INVENTOR(S) : Graves et al.

It is certified that error appears in the above-identified patent and that said Letters Patent is hereby corrected as shown below:

Claim 11, Column 7, line 17: Insert --air-- before "in" and after "dispensing"

Signed and Sealed this

Sixth Day of November, 2007

JON W. DUDAS
*Director of the United States Patent and Trademark Office*